US010052672B1

(12) United States Patent
Boudwin

(10) Patent No.: US 10,052,672 B1
(45) Date of Patent: Aug. 21, 2018

(54) COPPER PIPE BENDING TOOL

(71) Applicant: Brian Boudwin, Houma, LA (US)

(72) Inventor: Brian Boudwin, Houma, LA (US)

( * ) Notice: Subject to any disclaimer, the term of this patent is extended or adjusted under 35 U.S.C. 154(b) by 0 days.

(21) Appl. No.: 15/585,277

(22) Filed: May 3, 2017

(51) Int. Cl.
*B21D 39/08* (2006.01)
*B21D 9/04* (2006.01)
*B25G 1/10* (2006.01)

(52) U.S. Cl.
CPC ..... *B21D 9/04* (2013.01); *B25G 1/102* (2013.01)

(58) Field of Classification Search
CPC ..... B21D 41/021; B21D 39/20; B21D 31/04; B21D 41/02; B21D 39/04; B21D 41/025; B21D 9/04; B21C 3/16; B25G 1/102
USPC ..... 72/370.06, 479
See application file for complete search history.

(56) References Cited

U.S. PATENT DOCUMENTS 1,264,519 A * 4/1918 Harrington ..... B21D 1/06 29/8
1,685,636 A * 9/1928 Kemp ..... B21C 3/16 72/467
1,712,414 A 5/1929 Allen
2,908,193 A 10/1959 Gryniewicz
3,147,651 A 9/1964 Seigford
3,164,045 A * 1/1965 Kennedy ..... B21D 41/025 72/477
3,304,762 A * 2/1967 Skinner ..... B21D 41/025 72/479
3,504,515 A * 4/1970 Reardon ..... B21D 39/04 72/126
4,121,444 A * 10/1978 Duran ..... B25B 27/0007 72/114
4,161,112 A * 7/1979 Stump ..... B21C 3/16 72/283
4,587,832 A 5/1986 Illguth
4,843,860 A * 7/1989 Gray ..... B21D 41/02 72/318
4,964,222 A 10/1990 Keener
6,334,351 B1 * 1/2002 Tsuchiya ..... B21D 31/04 29/402.01
6,499,912 B2 12/2002 Coon
D577,553 S 9/2008 Faust
7,578,161 B1 * 8/2009 Sizemore ..... B21D 41/021 29/890.043
7,788,957 B2 * 9/2010 Okui ..... B21D 39/20 72/209
2010/0011833 A1 * 1/2010 Sizemore ..... B21D 41/021 72/370.06
2013/0305512 A1 * 11/2013 Green ..... A61F 2/86 29/428

* cited by examiner

*Primary Examiner* — David B Jones

(57) ABSTRACT

The copper pipe bending tool is a cylindrical tool that is inserted into the open end of a copper pipe or copper tubing and which provides a grasping point and leverage over the end of the piping. Using the copper pipe bending tool makes it easier to move or bend the piping to align it with a specific fitting where it needs to connect. The tool may provide an interface area for copper pipes of several different standard sizes. The tool may also provide a texture grasping area to help prevent the user's hand from slipping off of the tool while in use.

6 Claims, 3 Drawing Sheets

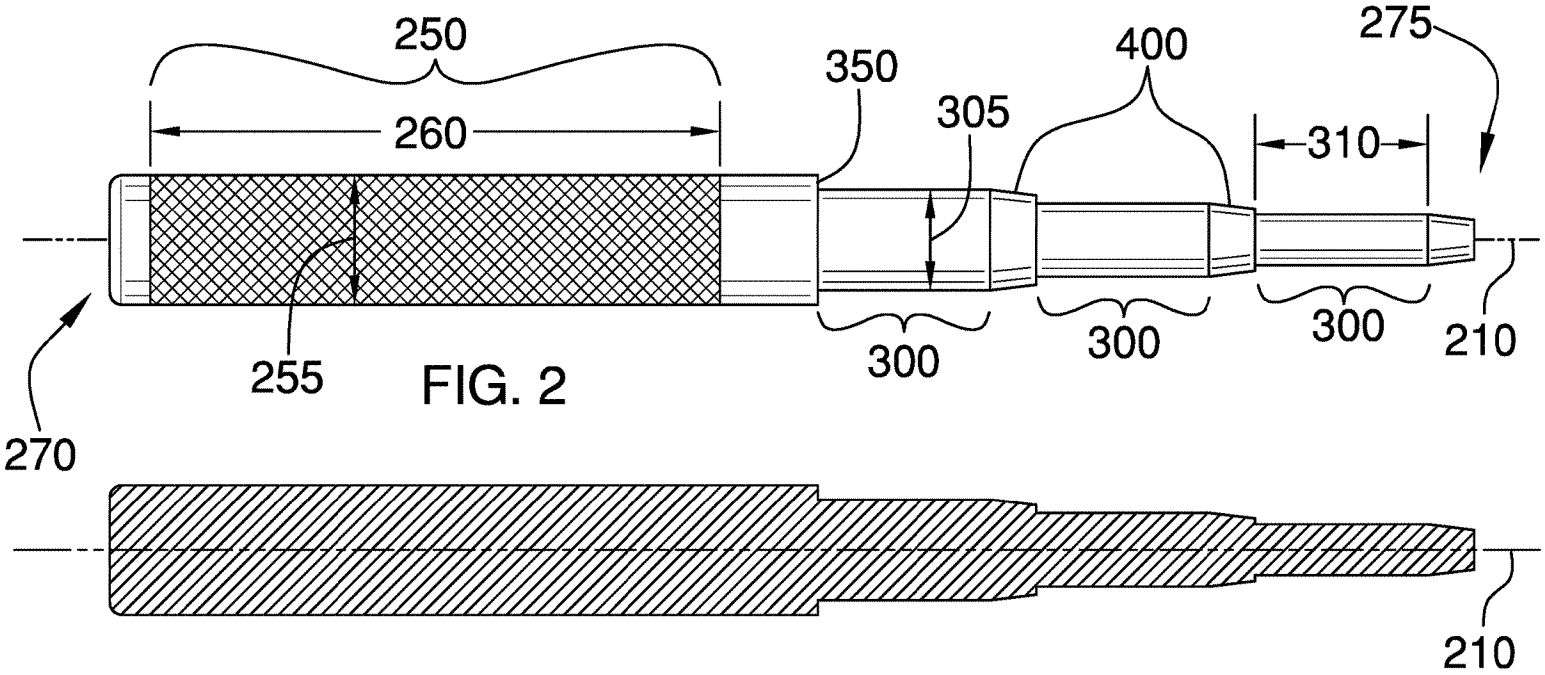
FIG. 2
FIG. 3
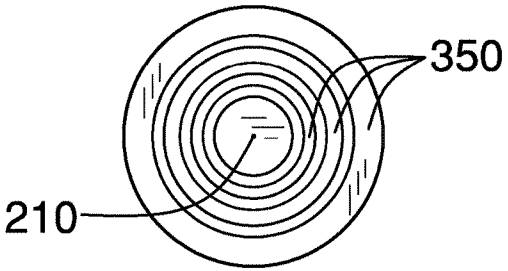
FIG. 4

COPPER PIPE BENDING TOOL

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of industrial tools, more specifically, a tool for moving and bending the end of a copper pipe or copper tubing.

Plumbers often have occasion to connect the end of a copper pipe or copper tubing to a specific plumbing fitting. It may be the case that the copper piping has a natural tendency to point in a direction other than directly at the fitting where it is to be connected. Manually aligning the copper piping with the fitting may be difficult especially if the copper piping is one of many copper pipes running to the same general area, such as might be encountered when connecting copper piping to a manifold. In such cases, it may be desirable to use a tool that provides a better grasp and additional leverage.

SUMMARY OF INVENTION

The copper pipe bending tool is a cylindrical tool that is inserted into the open end of a copper pipe or copper tubing and which provides a grasping point and leverage over the end of the piping. Using the copper pipe bending tool makes it easier to move or bend the piping to align it with a specific fitting where it needs to connect. The tool may provide an interface area for copper pipes of several different standard sizes. The tool may also provide a texture grasping area to help prevent the user's hand from slipping off of the tool while in use.

An object of the invention is to provide a tool that makes it easier to move, bend, and realign the end of a copper pipe or copper tubing.

Another object of the invention is to provide a tool that fits several different standard sizes of copper pipe or copper tubing.

A further object of the invention is to provide a tool with a textured grasping are for the user's hand, to minimize slipping.

These together with additional objects, features and advantages of the copper pipe bending tool will be readily apparent to those of ordinary skill in the art upon reading the following detailed description of the presently preferred, but nonetheless illustrative, embodiments when taken in conjunction with the accompanying drawings.

In this respect, before explaining the current embodiments of the copper pipe bending tool in detail, it is to be understood that the copper pipe bending tool is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the copper pipe bending tool.

It is therefore important that the claims be regarded as including such equivalent construction insofar as they do not depart from the spirit and scope of the copper pipe bending tool. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

FIG. 2 is a side view of an embodiment of the disclosure.

FIG. 3 is a cross-sectional view of an embodiment of the disclosure across 3-3 as shown in FIG. 1.

FIG. 4 is a front view of an embodiment of the disclosure.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description. As used herein, the word "or" is intended to be inclusive. As used herein, the terms "pipe', "tubing", and "piping" are used interchangeably to refer to a conduit for water that may be comprised of a continuous coiled roll or one or more straight sections of pipe joined together.

Figure 1:
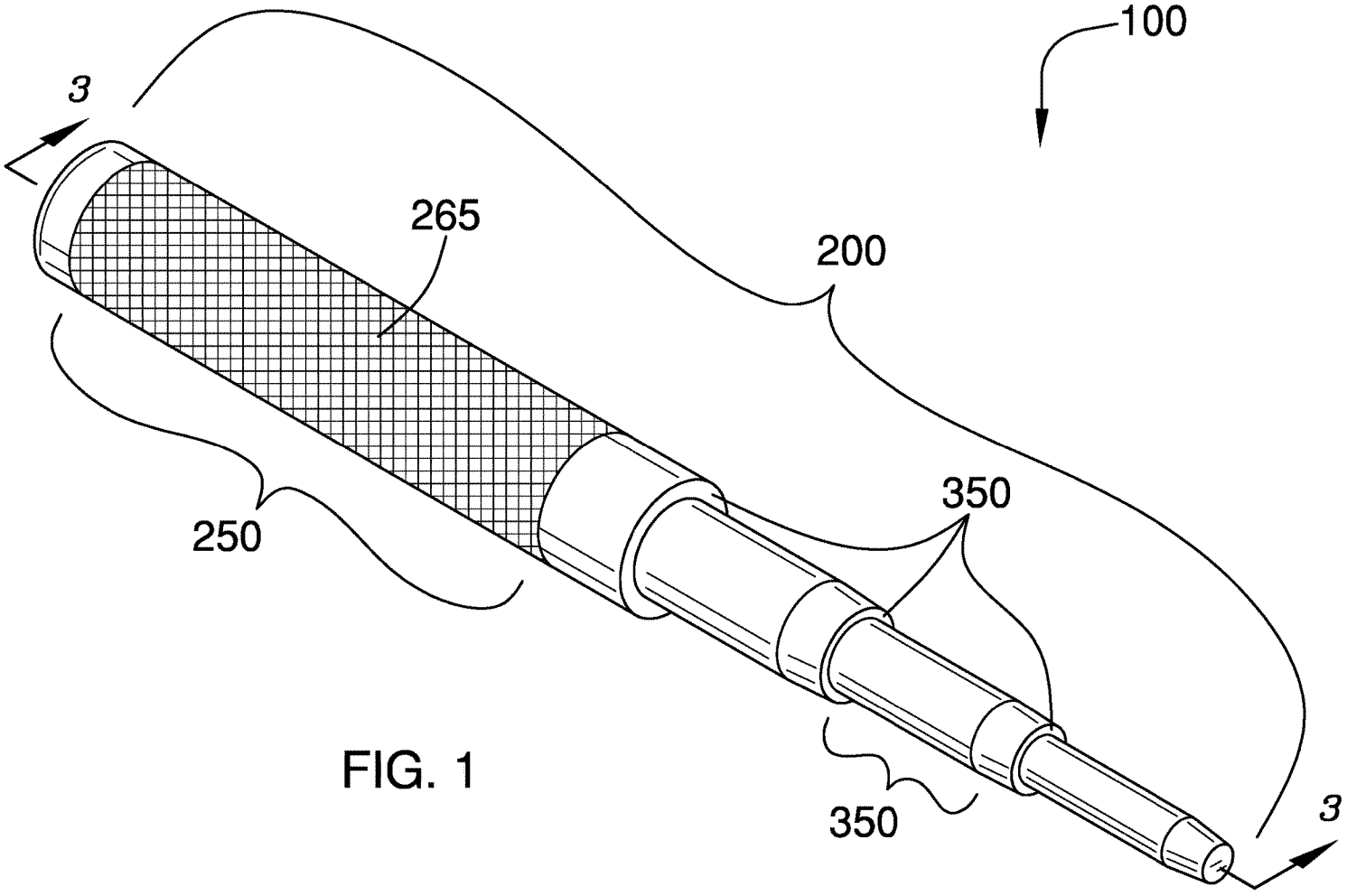
FIG. 1 is a perspective view of an embodiment of the disclosure.
Figure 5:
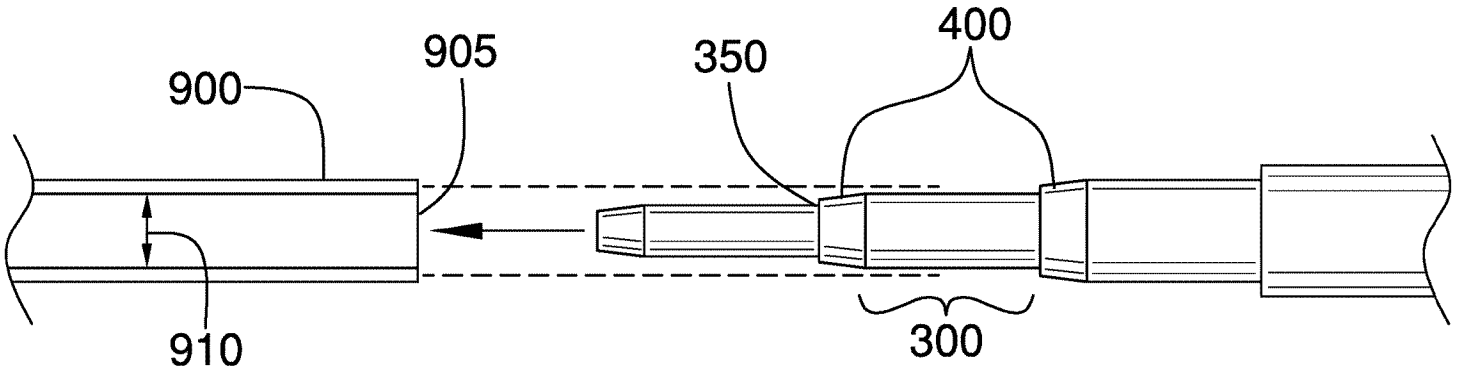
FIG. 5 is a side view of an embodiment of the disclosure ready to be inserted into a copper pipe.
Figure 6:
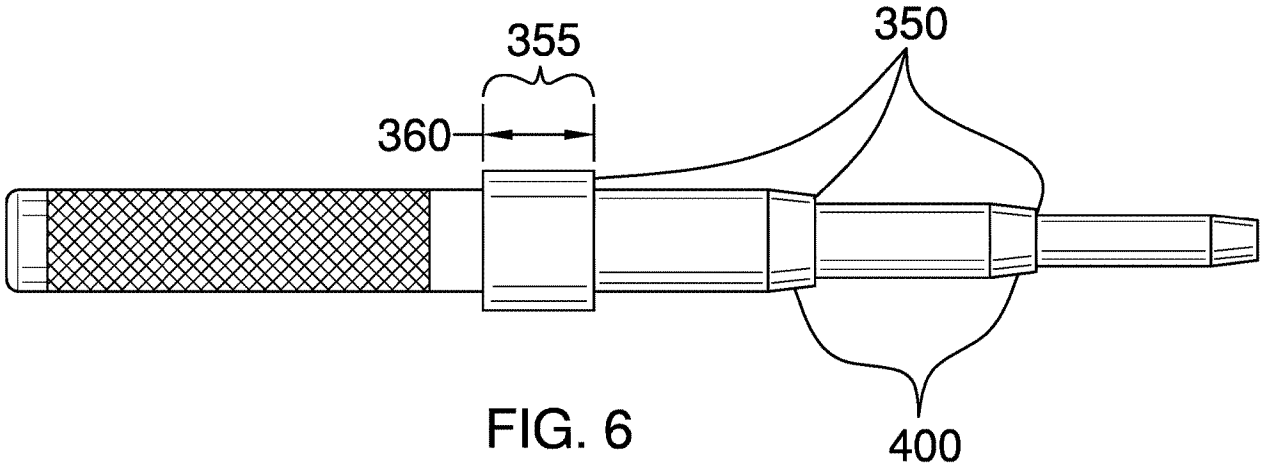
FIG. 6 is a side view of an embodiment of the disclosure having a pipe stop that is larger than the diameter of the grasping area.

Detailed reference will now be made to a first potential embodiment of the disclosure, which is illustrated in FIGS. 1 through 6.

The copper pipe bending tool 100 (hereinafter invention) comprises a body 200, a grasping area 250, one or more pipe interfaces 300 and one or more stopping surfaces 350. The invention 100 is inserted into an open end 905 of a copper pipe 900 and may be used to re-position the end of the copper pipe 900. Re-positioning the end of the copper pipe 900 may include moving the end of the copper pipe 900 even if it means that the copper pipe 900 must be bent to accomplish the re-positioning.

The body 200 may be a solid, round piece of metal machined to provide the features described herein. In a preferred embodiment, the body 200 is fabricated from stainless steel. In some embodiments, the body 200 may be fabricated from aluminum or steel.

The grasping area 250 is a cylindrical portion of the invention 100, which is adapted to be held by the user while the invention 100 is being used. A diameter of the grasping area 255 may be from ½ inches to 2 inches. In a preferred embodiment, the grasping area 250 is approximately 1¼ inches in diameter. A length of the grasping area 260 may be between approximately 3 inches and 8 inches so that it fits properly in a human hand without adding excess tool length. In a preferred embodiment, the length of the grasping area 260 is approximately 6 inches. The grasping area 250 may provide a textured surface 265 to prevent the user's hand from slipping from the invention 100. As non-limiting examples, the textured surface 265 may be a repeated cut pattern around the periphery of the grasping area 250, it may result from sandblasting the grasping area 250, it may be acid etched, or it may be formed by some other method of texturing a metal surface.

The one or more pipe interfaces 300 comprise cylindrical portions of the body 200 which vary in diameter. The one or more pipe interfaces 300 may be coaxial. In other words, a center axis of any one of the one or more pipe interfaces 300 may be co-linear with a longitudinal center axis 210 through the body 200 of the invention 100. When the invention 100 comprises more than one of the one or more pipe interfaces 300, each one of the one or more pipe interfaces 300 has a pipe interface diameter 305, which is different from any of the other ones of the one or more pipe interfaces 300.

The one or more pipe interfaces 300 are arranged on the invention 100 in order of increasing diameter—the one or more pipe interfaces 300 with the pipe interface diameter 305 that is the smallest is at a non-grasping end 275 of the invention 100. The one or more pipe interfaces 300 with the pipe interface diameter 305 that is the largest is located closest to the grasping area 250. This ordering is important because the copper pipe 900 having a larger diameter can slide over and past the one or more pipe interfaces 300 having smaller diameters to reach the one or more pipe interfaces 300 having a matching diameter for the copper pipe 900, however the copper pipe 900 having a smaller diameter cannot slide over the one or more pipe interfaces 300 having non-matching larger diameters.

The pipe interface diameter 305 for a given one of the one or more pipe interfaces 300 is chosen to match a standard size of copper pipe or copper tubing. The pipe interface diameter 305 is no larger than an inside diameter of the copper pipe 910 that it is intended to fit. In practice, the pipe interface diameter 305 is selected to be slightly smaller than the inside diameter of the copper pipe 910 so that the invention 100 may be inserted into the copper pipe 900 easily. In a preferred embodiment, the pipe interface diameter 305 is 10 to 20% smaller than the inside diameter of the copper pipe 910 that it is intended to fit.

As non-limiting examples, in preferred embodiments, the pipe interface diameter 305 for a standard pipe diameter of ½ inch may be approximately 0.45 inches, the pipe interface diameter 305 for a standard pipe diameter of ¾ inch may be approximately 0.625 inches, the pipe interface diameter 305 for a standard pipe diameter of 1 inch may be approximately 0.82 inches, the pipe interface diameter 305 for a standard pipe diameter of 1¼ inches may be approximately 1.06 inches, the pipe interface diameter 305 for a standard pipe diameter of 1½ inches may be approximately 1.31 inches, and the pipe interface diameter 305 for a standard pipe diameter of 2 inches may be approximately 1.75 inches.

A pipe interface length 310 is chosen to provide good contact with the copper pipe and to avoid unnecessary tool length. In a preferred embodiment, the pipe interface length 310 may be approximately 2⅛ inches.

Each one of the one or more stopping surfaces 350 is a surface that serves to stop the motion of the invention 100 into the copper pipe 900 when the invention 100 is inserted into the copper pipe 900. There is one of the one or more stopping surfaces 350 associated with each one of the one or more pipe interfaces 300. Each one of the one or more stopping surfaces 350 takes the form of an increase in diameter of the body 200 of the invention 100 as the body 200 progresses from the non-grasping end 275 of the invention 100 to a grasping end 270. The one or more stopping surfaces 350 are adjacent to the one or more pipe interfaces 300 which they are associated with and the one or more stopping surfaces 350 are positioned on the grasping area 250 side of the one or more pipe interfaces 300 that the one or more stopping surfaces 350 are associated with. The one or more stopping surfaces 350 are oriented to be normal to the longitudinal center axis 210.

The boundary between the one or more pipe interfaces 300 and the one or more stopping surfaces 350 may comprise one or more chamfered guides 400. The one or more chamfered guides 400 comprise beveled edges to help guide the invention 100 into the copper pipe 900.

In some embodiments, the grasping area 250 may have a larger diameter than the largest of the one or more pipe interfaces 300 and, in this case, the one or more stopping surfaces 350 for the largest of the one or more pipe interfaces 300 may simply be the offset due to the difference between the diameter of the grasping area 255 and the pipe interface diameter 305 of the largest of the one or more pipe interfaces 300.

In some embodiments, the pipe interface diameter 305 of the largest of the one or more pipe interfaces 300 will be nearly equal to or greater than the diameter of the grasping area 255. In this case, the body 200 may be thickened to form a pipe stop 355 which has a diameter that is larger than the diameter of the grasping area 255 or the pipe interface diameter 305 of any of the one or more pipe interfaces 300. This will assure that one of the one or more stopping surfaces 350 is available for the largest of the one or more pipe interfaces 300. The pipe stop 355, when present, will be located between the grasping area 250 and the largest of the one or more pipe interfaces 300. In a preferred embodiment, a length of the pipe stop 360, when the pipe stop 355 present, is approximately ⅞ inch.

With respect to the above description, it is to be realized that the optimum dimensional relationship for the various components of the invention described above and in FIGS. 1 through 6, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A copper pipe bending tool comprising:

a body, a grasping area, one or more pipe interfaces and one or more stopping surfaces;

wherein the copper pipe bending tool is inserted into an open end of a copper pipe and is used to re-position the end of the copper pipe;

wherein the grasping area is a cylindrical portion of the copper pipe bending tool, which is adapted to be held by the user while the copper pipe bending tool is being used;

wherein the one or more pipe interfaces comprise cylindrical portions of the body which vary in diameter;

wherein the one or more pipe interfaces are coaxial;

wherein when the copper pipe bending tool comprises more than one of the one or more pipe interfaces, each one of the one or more pipe interfaces has a pipe interface diameter that is different from any of the other ones of the one or more pipe interfaces;

wherein each one of the one or more stopping surfaces is a surface that serves to stop the motion of the copper pipe bending tool into the copper pipe when the copper pipe bending tool is inserted into the copper pipe;

wherein there is one of the one or more stopping surfaces associated with each one of the one or more pipe interfaces;

wherein each one of the one or more stopping surfaces takes the form of an increase in diameter of the body of the copper pipe bending tool as the body progresses from a non-grasping end of the copper pipe bending tool to a grasping end;

wherein re-positioning the end of the copper pipe includes moving the end of the copper pipe;

wherein re-positioning the end of the copper pipe includes bending the copper pipe;

wherein the grasping area provides a textured surface to prevent the user's hand from slipping from the copper pipe bending tool;

wherein the one or more pipe interfaces are arranged on the copper pipe bending tool in order of increasing diameter;

wherein the one of the one or more pipe interfaces with the pipe interface diameter that is smallest is adjacent to an end of the copper pipe bending tool that is opposite of the grasping end;

wherein the one or more pipe interfaces with the pipe interface diameter that is the largest is located closest to the grasping area;

wherein the pipe interface diameter for a given one of the one or more pipe interfaces is chosen to match a size of copper pipe;

wherein the pipe interface diameter is no larger than an inside diameter of the copper pipe;

wherein the one or more stopping surfaces are adjacent to the one or more pipe interfaces which they are associated with;

wherein the one or more stopping surfaces are positioned on a grasping area side of the one or more pipe interfaces that the one or more stopping surfaces are associated with;

wherein the one or more stopping surfaces are oriented to be normal to a longitudinal center axis;

wherein the boundary between the one or more pipe interfaces and the one or more stopping surfaces comprises one or more chamfered guides;

wherein the one or more chamfered guides comprise beveled edges to help guide the copper pipe bending tool into the copper pipe;

wherein the body is thickened to form a pipe stop which has a diameter that is larger than the diameter of the grasping area or the pipe interface diameter of any of the one or more pipe interfaces;

where the pipe stop is located between the grasping area and the largest of the one or more pipe interfaces.

2. The copper pipe bending tool according to claim 1 wherein the body is a solid, round piece of metal machined.

3. The copper pipe bending tool according to claim 2 wherein the body is fabricated from stainless steel or fabricated from aluminum.

4. The copper pipe bending tool according to claim 3 wherein a diameter of the grasping area is from ½ inch to 2 inches.

5. The copper pipe bending tool according to claim 3 wherein a length of the grasping area is between 3 inches and 8 inches.

6. The copper pipe bending tool according to claim 1 wherein the length of the pipe stop is approximately ⅞ inch.

* * * * *